US010912157B2

(12) United States Patent
Tulloch et al.

(10) Patent No.: US 10,912,157 B2
(45) Date of Patent: Feb. 2, 2021

(54) HEAT GENERATOR

(71) Applicant: ROTAHEAT LIMITED, Salisbury (GB)

(72) Inventors: Andrew Malcolm Tulloch, Reading (GB); Robert Thompson, Salisbury (GB)

(73) Assignee: Rotaheat Limited, Wiltshire (GB)

( * ) Notice: Subject to any disclaimer, the term of this patent is extended or adjusted under 35 U.S.C. 154(b) by 307 days.

(21) Appl. No.: 16/076,442

(22) PCT Filed: Feb. 10, 2017

(86) PCT No.: PCT/GB2017/050369
§ 371 (c)(1),
(2) Date: Aug. 8, 2018

(87) PCT Pub. No.: WO2017/137776
PCT Pub. Date: Aug. 17, 2017

(65) Prior Publication Data

US 2019/0053334 A1 Feb. 14, 2019

(30) Foreign Application Priority Data

Feb. 10, 2016 (GB) ..... 1602399.6
Oct. 28, 2016 (GB) ..... 1618275.0

(51) Int. Cl.
*H05B 6/10* (2006.01)
*H05B 6/02* (2006.01)
*H05B 6/00* (2006.01)

(52) U.S. Cl.
CPC ..... *H05B 6/108* (2013.01); *H05B 6/109* (2013.01)

(58) Field of Classification Search
CPC ..... H05B 6/109; H05B 6/108
USPC ..... 219/631, 618, 628, 629, 630, 672
See application file for complete search history.

(56) References Cited

U.S. PATENT DOCUMENTS

| | | | | |
|---|---|---|---|---|
| 4,217,475 | A | 8/1980 | Hagerty | |
| 5,012,060 | A | 4/1991 | Gerard et al. | |
| 5,914,065 | A | 6/1999 | Alavi | |
| 2013/0092681 | A1* | 4/2013 | Nangle | H05B 6/108 219/630 |
| 2019/0257555 | A1* | 8/2019 | Rowe | F25B 21/00 |

FOREIGN PATENT DOCUMENTS

| | | |
|---|---|---|
| EP | 1 130 336 | 9/2001 |
| WO | 97/46051 | 12/1997 |
| WO | 2014/167429 | 10/2014 |
| WO | 2015/025146 | 2/2015 |

OTHER PUBLICATIONS

International Search Report for PCT/GB2017/050369, dated May 15, 2017, 2 pages.

* cited by examiner

*Primary Examiner* — Quang T Van
(74) *Attorney, Agent, or Firm* — Nixon & Vanderhye P.C.

(57) ABSTRACT

A heat generator having first and second members disposed around a shaft. One of the members has an electrically conducting portion and the other of the members has magnets mounted thereon opposite the electrically conducting portion. A passage for fluid to be heated between the magnets and the electrically conducting portions is thus formed. The magnets are arranged so that their magnetic fields intersect the electrically conducting portions. The heat generator includes an impeller and heats liquid as the high pressure drive of a hydraulic motor.

19 Claims, 8 Drawing Sheets

HEAT GENERATOR

This application is the U.S. national phase of International Application No. PCT/GB2017/050369 filed 10 Feb. 2017, which designated the U.S. and claims priority to GB Patent Application No. 1602399.6 filed 10 Feb. 2016, and GB Patent Application No. 1618275.0 filed 28 Oct. 2016, the entire contents of each of which are hereby incorporated by reference.

TECHNICAL FIELD

This invention relates to a heat generator. It can be used to provide heat, generate hot water or as part of a water treatment/desalination system.

BACKGROUND ART

Known rotary heat generators such as described in WO 2015/025146 A (ROTAHEAT LIMITED) 26 Feb. 2015 using eddy current induction in a rotating disc to heat water have relatively low heat capacity because the theoretical disc size required for large heating capacity becomes unmanageable.

DISCLOSURE OF INVENTION

According to the present invention a heat generator comprises a first member and second member disposed around a shaft, the first member having a disc-like portion extending radially from the shaft and an electrically conducting cylinder extending laterally from the disc-like portion and co-axially with the shaft, the second member having a disc-like portion extending radially from the shaft and cylindrical portion, extending laterally from the disc-like portion and co-axially with the shaft and having magnets mounted thereon facing the electrically conducting cylinder and with a passage for liquid to be heated, coaxial with the shaft, defined between the cylindrical portion of the second member and the electrically conducting cylinder and in which one member may rotate with respect to the other member.

In one arrangement, the member which rotates has an associated impeller that in operation drives liquid into the passage.

In an arrangement in which first member rotates, the impeller can be formed on the face of the disc like portion facing the disc like portion of the second member.

In these arrangements the liquid can come from a high pressure inlet to rotate the impeller and one member about the other.

In another arrangement, one or other of the members is mounted on the shaft and the other member is fixed.

In this arrangement the shaft is driven directly by a wind turbine, water turbine, or a hydraulic motor or other source of rotational power. In such an arrangement an impeller mounted on the member mounted on the shaft can be provided to drive liquid through the passage.

In another arrangement a hydraulic motor is mounted directly on the rotatable member to rotate that member, the hydraulic motor being supplied with high pressure hydraulic fluid from a hydraulic pump. In such an arrangement an impeller mounted on the member mounted on the shaft can be provided to drive liquid through the passage.

In one arrangement the cylindrical portions each have a plain surface opposite each other, in an alternative arrangement the cylindrical surface of the rotating member opposite the other member has screw pattern on the surface to act as a further impeller to assist flow along the passage, In one arrangement embodiment the first member comprises at least two coaxial electrically conducting cylinders, an inner cylinder and an outer cylinder, mounted on a common disc-like portion and the second member has one or more its cylindrical portions nesting between the conducting cylinders, the cylindrical portion(s) of the second member having magnets mounted opposite the conducting cylinders, with two or more passages formed between the conducting cylinders and the cylindrical portion(s). Conveniently, in such an embodiment, the disc-like portion of the second member is disposed around the shaft towards one end of the heat generator and the disc-like portion of the first member towards the other end of the heat generator. Liquid to be heated flows in the passages created parallel to the axis either in parallel or sequentially through a first passage then a second co-axially with the shaft.

In one arrangement, liquid having passed through the heat generator passes on to a heat exchanger or heat recovery unit.

In one arrangement, one member is driven by high pressure liquid which is then passed through the passage to be heated.

In one arrangement the magnets are disposed around the cylindrical portion of the second member.

In a second arrangement the magnets are disposed longitudinally along the length of a cylinder and parallel to the axis of the shaft. This arrangement of magnets enables an increase in the rate of flow of fluid through the heat generator.

In the second arrangement, ideally the poles of the magnets alternate around the cylindrical portion of the second member.

Normally, the magnets are disposed around or along the outside of the cylindrical portion of the second member, but arrangements are possible where the magnets are disposed inside the cylindrical portion of the outer member.

When the magnets are distributed on the outside of the cylindrical portion of the second member, in one arrangement they are inset in longitudinal grooves formed in the cylindrical portion of the second member. On the inner surface of the cylindrical portion of the second member, longitudinal groves can be formed between the grooves on the outside of the cylindrical portion of the second member, thereby adding flow of water between the first and cylindrical portion of the second members.

The disc-like portion of one member may have a hydraulic motor mounted thereon its high pressure input connected to the high pressure output of a hydraulic pump and its low pressure output connected to the low pressure input of the hydraulic pump, with liquid to be heated drawn onto the passage.

The hydraulic pump may be driven by a wind turbine, water turbine, a rotating propeller arrangement, or some other source of power.

Further features of the invention are set out in the accompanying description and claims. The heat generator of this invention may be integrated with a heat exchanger or be part of a hot water system or be part of a water treatment/desalination system.

In the invention the magnets may be permanent magnets or electro-magnets.

BRIEF DESCRIPTION OF DRAWINGS

The invention will now be described, by way of example only, with reference to the accompanying drawings, in which.

DESCRIPTION OF EXAMPLES OF THE INVENTION ILLUSTRATED IN DRAWINGS

Figure 1:
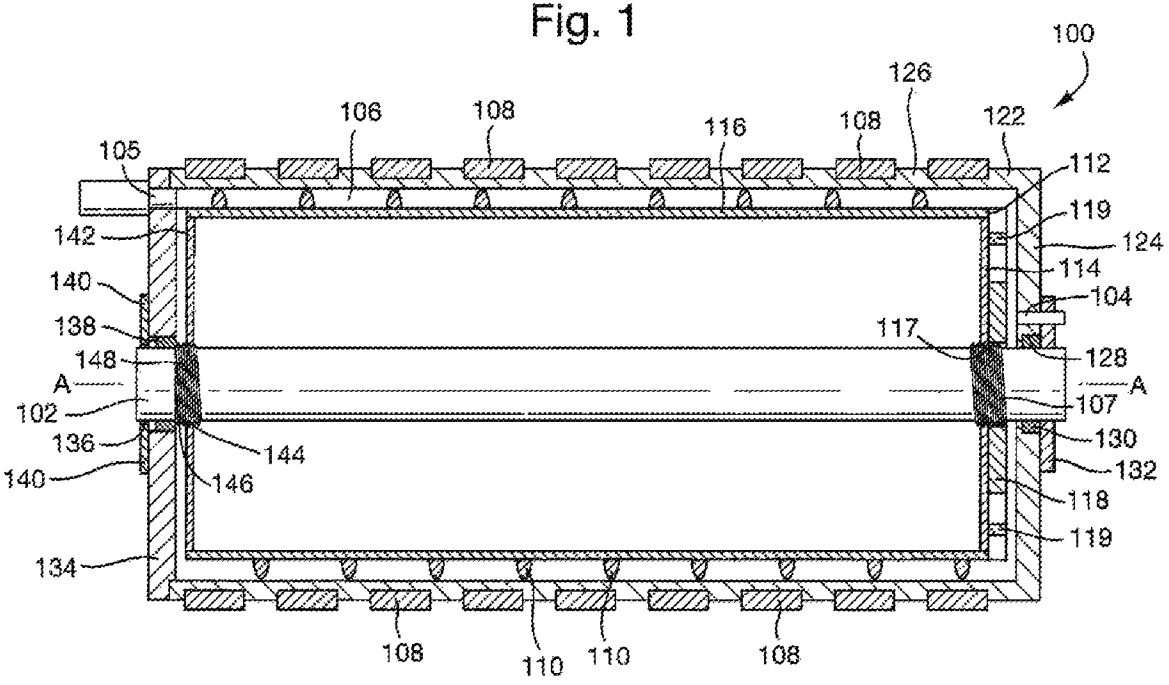
FIG. 1 shows an example of the first embodiment of a heat generator according to the invention, in which high pressure liquid passing through an impeller rotates one of the members.
Figure 2:
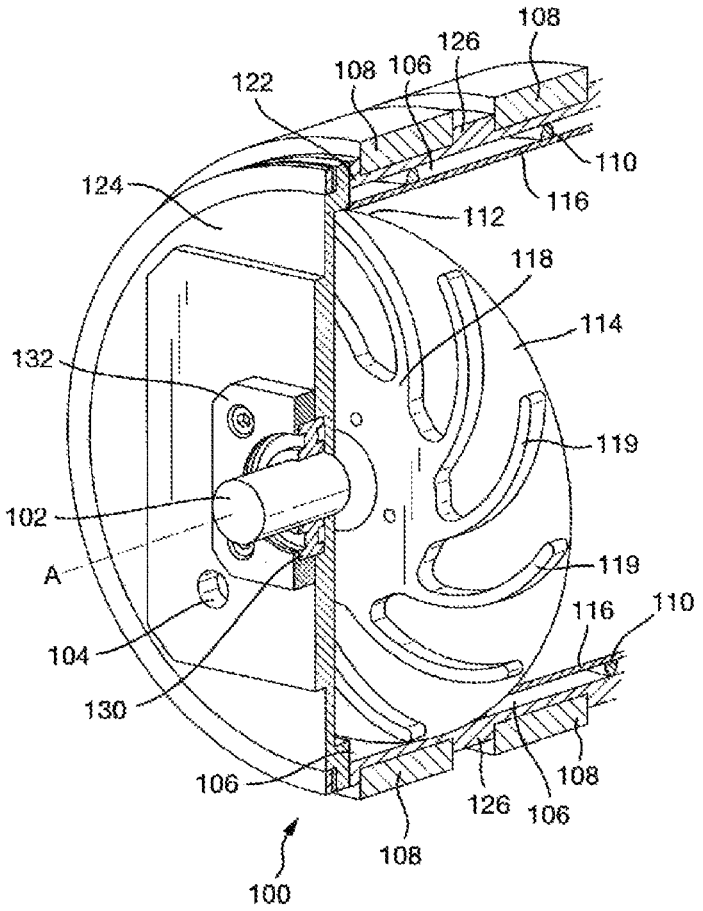
FIG. 2 is a partial section of the heat generator of FIG. 1 showing an impeller driving liquid to be heated.

In FIGS. 1 and 2 a heat generator 100 according to the invention comprises a first member 112 and a second member 122 disposed around a shaft 102 having a central axis A. The first member has a disc-like portion 114 extending radially from the shaft and an electrically conducting cylinder 116 extending laterally from the disc-like portion 114 and co-axially with the shaft A. The second member also has a disc-like portion 124 extending radially from the shaft 102 and a cylindrical portion 126, extending laterally from the disc-like portion and co-axially with the shaft 102. Magnets 108 are mounted and set into the cylindrical portion 126 opposite the electrically conducting cylinder 116 and with a passage 106 for liquid to be heated coaxial with the shaft 102 between the electrically conducting cylinder 116 and the cylindrical portion 126.

The second member 122 has a central hole 128 in its disc-like portion 124 through which the shaft 102 passes. Bearings 130 are inset into disc-like portion 124, around the central hole 128 and held in place by keeper plates 132. The bearings 130 support the shaft 102 and allow it to turn with respect to the second member 122. The first member 112 has an inner screw thread 117 which screws onto an outer screw thread 107 on shaft 102, fixing the first member 112 in position on the shaft 102, so that the first member 112 rotates with shaft 102, and causing the conducting cylinder 116 to rotate in the magnetic fields of magnets 108, causing the conducting cylinder to heat.

The face of the disc-like portion 114 of first member 112 is formed as an impeller 118, with a plurality of impeller blades 119 formed in the surface.

High pressure liquid to be heated is fed to the input 104 on the disc-like portion 124 of second member 122. The high pressure liquid drives the impeller 118 causing the first member 112 and shaft 102 to rotate about axis A. The liquid on leaving the periphery of impeller 118 passes through passage 106 in parallel to axis A where it is heated by the heat generated in conducting cylinder 116 by its intersecting the magnetic fields of magnets 108. After passing through passage 106, the heated liquid leaves the heat generator 100 through one or more ducts 105 through sealing plate 134, which is fixed and sealed to the cylindrical portion 126.

The sealing plate 134 has a central aperture 136 containing a bearing 138 providing additional support for shaft 102. The bearing is held in place by an endplate 140.

A sealing cover 142 prevents hot liquid accesses the volume contained between conducting cylinder 116 and the disc-like portion 114 of first member 112. The sealing cover has a central bore 144 with an inner thread 146, engaging with a further outer thread 148 and thus providing additional support for the first member 112 on shaft 102.

From the output 105, hot liquid may be passed to one or more heat exchangers or, for example, a coil in a hot water tank to recover and use the heat in the liquid. From there the liquid may pass through a hydraulic pump, which can be, for example, wind or water turbine driven, and pumped back under pressure to the input 104.

The electrically conducting cylinder 116, which rotates, has a screw 110 formed in its surface opposite the cylindrical portion 126 of fixed member 122. The screw acts to aid flow of liquid through the passage in a controlled manner, providing that the liquid remains in the passage for sufficient time to heat adequately but not so long that it boils prematurely.

Figure 3:
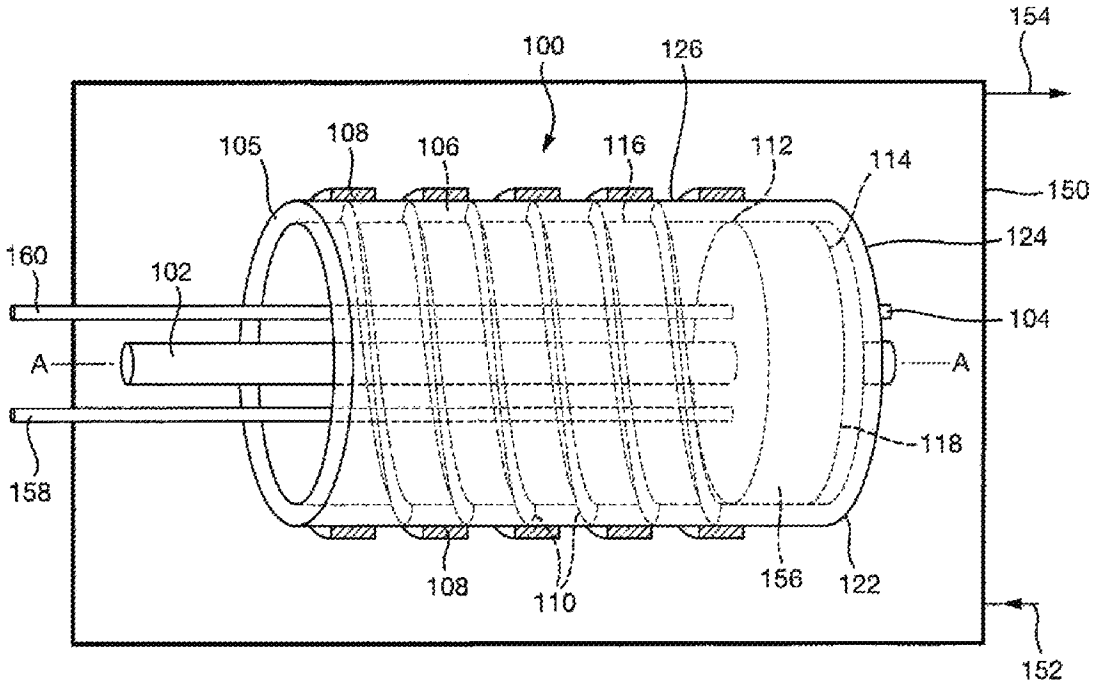
FIG. 3 shows a second example of the first embodiment of a heat generator according to the invention.

In FIG. 3 an alternative arrangement is shown. Here the heat generator is immersed in a hot water tank 150. A hydraulic motor 156 is mounted on the opposed side of disc-like portion 114 to the impeller 128. The hydraulic motor 156 is driven by liquid between a high pressure input 158 and a low pressure output 160, turning the first member 112 about the shaft 102. An input 104 is provided in the disc like portion 124 of the second member 122. The impeller 128 pushes water drawn in through input 104 into the passage 106 parallel to axis A between the conducting cylinder 116 of the first member 112 and the cylindrical portion 126 of the second member 122, The cylindrical portion of the second member has members 108 inset therein. The water passing through passage 106 is heated by heat generated in the conducting cylinder 116 by its rotation in the magnetic fields of magnets 108. Water thus heated is discharged back into the hot water tank through annular outlet 105 between the ends of the cylindrical member 126 and conducting cylinder 116. The hydraulic motor 156 is a standard hydraulic motor and need not be described in detail here.

The open end of conducting cylinder 116 is optionally sealed with a sealing cover 142 mounted and supported in the same way as the sealing cover 142 shown in FIG. 1. Should the open end of cylindrical portion 126 of the second member require further support, an sealing plate can be provided mounted in the same way as sealing plate 134 shown in FIG. 1. In that case, one or more outlets to allow heated water back to the tank will be needed in the sealing plate.

Figure 4:
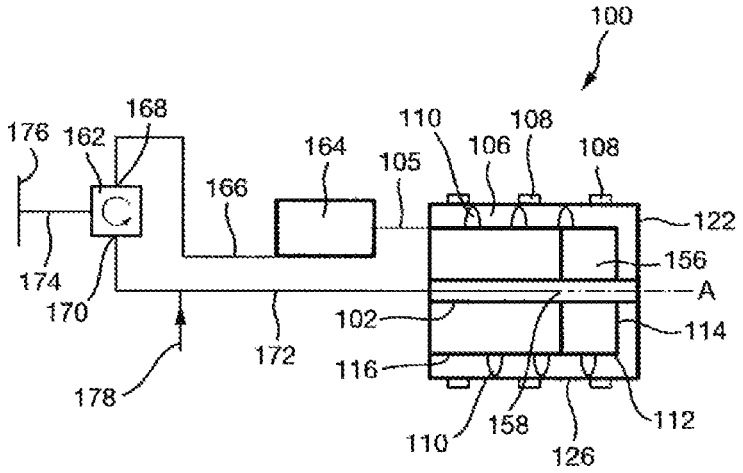
FIG. 4 is a schematic drawing a closed hydraulic fluid circuit to supply high pressure fluid to the heat generator of FIG. 3 and using the fluid supply though the hydraulic motor as the working fluid of the heat generator.

A schematic drawing of a further alternative arrangement is shown in FIG. 4. As in FIGS. 1 to 3 a heat generator 100 comprises a first member 112 having a conducting cylinder 116 and a second member 122 with a cylindrical portion 126. The conducting cylinder 116 and cylindrical portion 126 have a common axis A with the shaft 102. A hydraulic motor is 156 mounted on the disc like portion 114 of the first member 112 to rotate the first member about axis A. The cylindrical portion 126 of the second member second member has magnets 108 inset into its surface as in FIGS. 1 to 3. The hydraulic motor 156 is driven by high pressure fluid from a hydraulic pump 162 though input 158. However in this case rather than being discharged from the hydraulic motor directly through an outlet as shown in FIG. 3, the fluid on leaving the motor passes through the gap 106 between the conducting cylinder 116 and the cylindrical portion 126 on in which the magnets 108 are inset where it is heated by the heat generated in the electrically conducting cylinder 114 by its rotation in the magnetic fields of the of the magnets 108. After passing through the passage 106, the liquid leaves the heat generators through outlet 105, from where it passes to a heat exchanger 164 or other heat recovery system for use.

As in FIG. 1, in FIG. 3 the electrically conducting cylinder 116, which rotates, has a screw 110 formed in its surface opposite the cylindrical portion 126 of fixed member 122.

In FIG. 4, the liquid driving the hydraulic motor 156 is in a closed loop. From the heat exchanger or other heat recovery system 164, it passes through duct 166 to the input of hydraulic pump 162. The output 170 of hydraulic pump 162 is taken through duct 172 to the input 158 of hydraulic motor 156. The hydraulic pump 162 is driven by a shaft 174 from a wind or water turbine 176 or some other rotational power source. As necessary liquid in the system can be topped up by adding addition liquid through valve 178.

Figure 5:
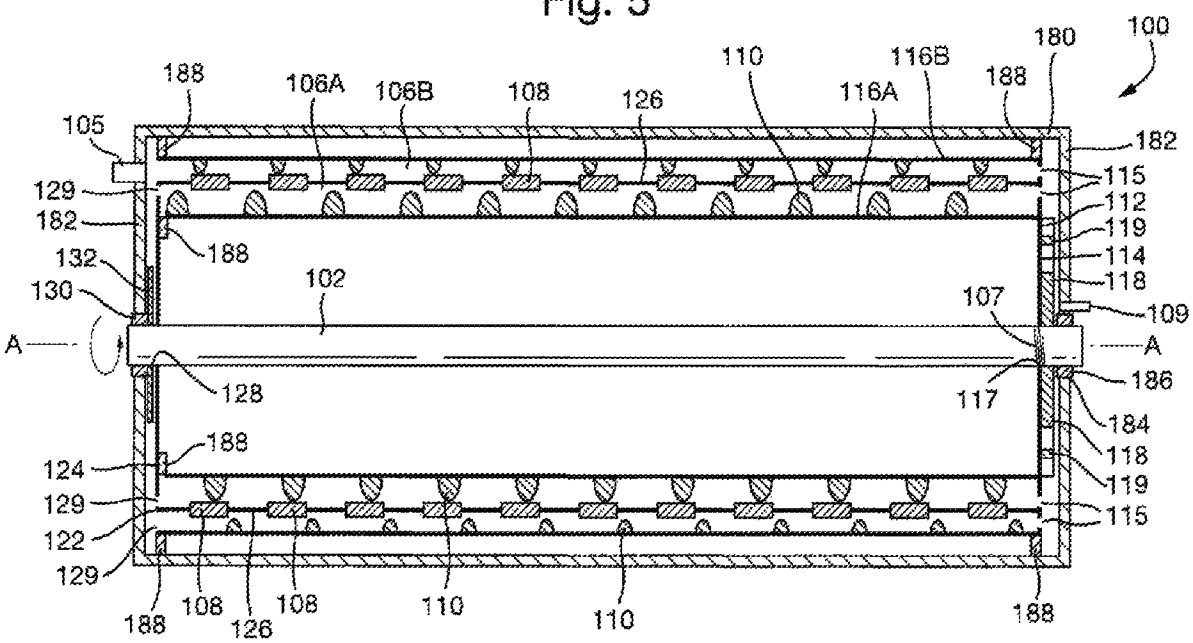
FIG. 5 is a schematic cross section of a still further example of the first embodiment of the invention.

Moving to the further example of FIG. 5. In the heat generator 100, the shaft 102 is rotated about axis A by a motor, normally a hydraulic motor or other source of rotational energy, external to the device. The first member 112 comprises a disc-like portion 114 on which to co-axial electrically conducting cylinders, an inner electrically conducting cylinder 116A and an outer electrically conducting cylinder 116B cylinder are mounted. The second member 122 is mounted around the shaft 102, and has a cylindrical portion 126, extending between the conducting cylinders 116.

The cylindrical portion 126 has magnets 108 inset into its surface on both sides. The disc like portion 124 of the second member, is towards the opposite end of the heat generator to the disc-like portion 114 of the first member 112 As in FIG. 1, the disc like portion 124 had a central hole 128 through which the shaft 102 passes. Bearings 130 are inset into disc-like portion 124, around the central hole 128 and held in place by keeper plates 130. The bearings 130 support the shaft 102 and allow it to turn with respect to the second member 122. The first member 112 has an inner screw thread 117 which screws onto an outer screw thread 107 on shaft 102, fixing the first member 112 in position on the shaft 102, so that the first member 112 rotates with shaft 102, and causing the conducting cylinders 116A and 116B to rotate in the magnetic fields of magnets 108, causing the conducting cylinders to heat.

The construction forms two fluid paths between the conducting cylinder 116A and the cylindrical portion 126, and between the conducting cylinder 116B and the cylindrical portion 126 respectively. Both fluid paths 116A and 116B are parallel to the axis A of shaft 102 and co-axial therewith.

The outer conducting cylinder 116B, if not protected would get very hot, for safety, therefore the generator 100 is mounted in a cylindrical case 180 having end plates 182 with central apertures 184 and bearings 186 through which the shaft 102 passes.

High pressure fluid is pumped into the heat generator 100 through input 104 which passes through the case end plate 182 into the volume between the disc-like portion 114 of the first member 112 and the case end plate 182. A number of apertures 119 in the disc-like portion 114 allow liquid under pressure into the passages 106A and 106B. Seals 188 around the outside of the outer conducting cylinder prevent the liquid entering the gap between the outer conducting cylinder 116B and the case 180.

The liquid passes through passages 106A and 106B where it is heated from the heat generated tin the conducting cylinders 116A and 116B by their rotation in the magnetic fields of magnets 108. After the liquid is heated its passes out of the heat generator through outlet 105 in the case 180. To allow heated liquid to pass from passage 106A to the outlet, apertures 129 are provided in the disc-like portion 124 of member 122.

It can be seen that the arrangement of FIG. 5 doubles the heating capacity of the generator. As an alternative to the liquid flowing in parallel along passages 106A and 106B, the designed flow arrangements can be such that the liquid flows sequentially through passages 106A and 106B, this will have the effect of increasing the output temperature with a reduced flow volume.

It is also possible to add further electrically conducting cylinders to the first member 112 and one or more further cylindrical portions having magnets mounted thereon to member 122, the cylindrical portions nesting between the electrically conducting cylinders.

As in FIGS. 1 and 3 the electrically conducting cylinders 116A and 116B, which rotate, have screws 110 formed in their surfaces opposite the cylindrical portion 126 of fixed member 122.

Figure 6:
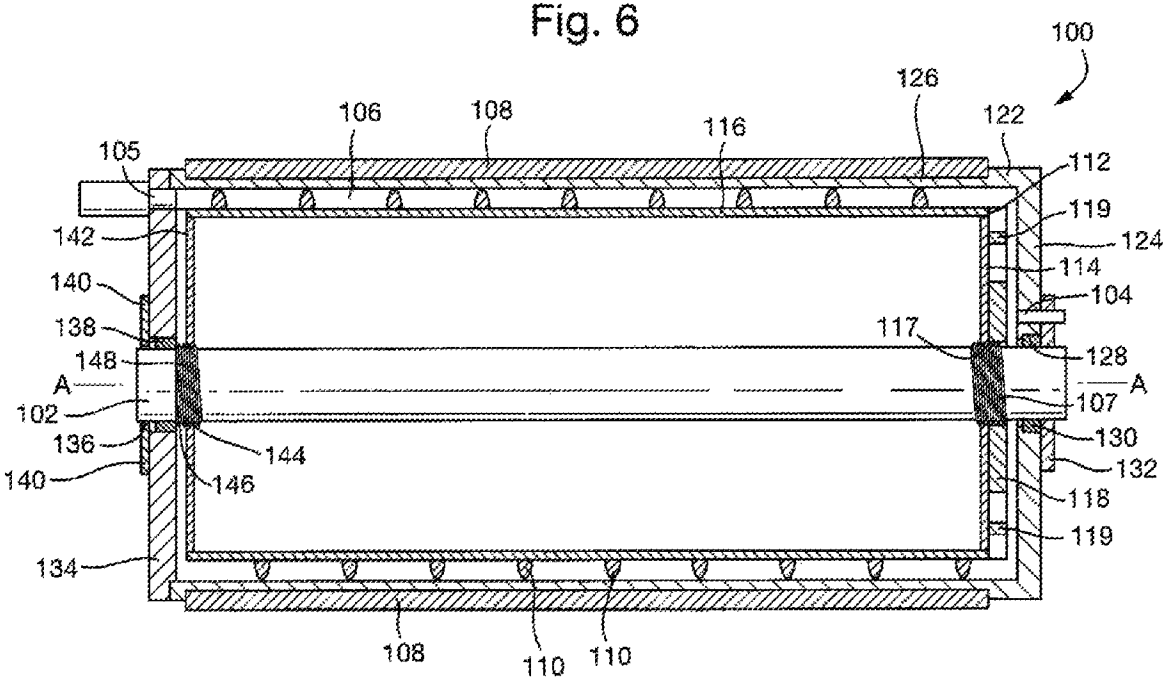
FIG. 6 is similar to FIG. 1 but showing an alternative configuration of magnets.
Figure 7:
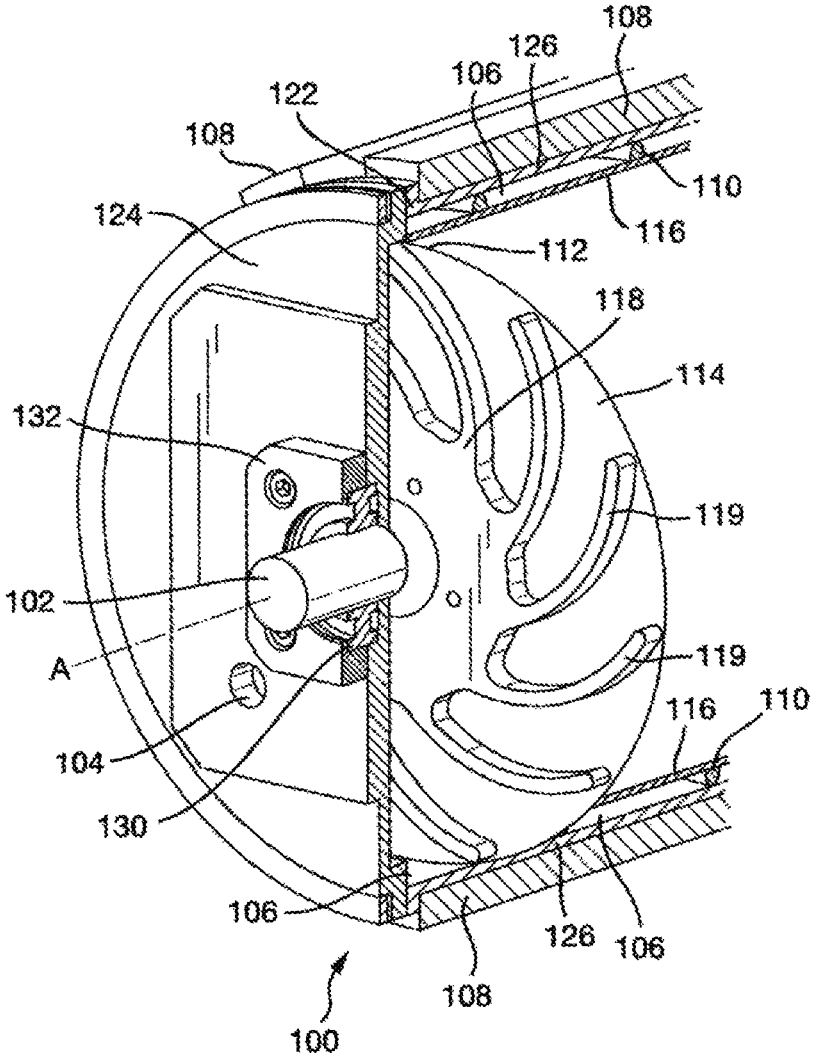
FIG. 7 is similar to FIG. 2 but showing the alternative configuration of magnets.

FIGS. 6 and 7 are identical to FIGS. 1 and 2 save that a plurality of magnets 108 are disposed the length of the cylindrical portion 126 of the second member 122 rather than around it.

Figure 8:
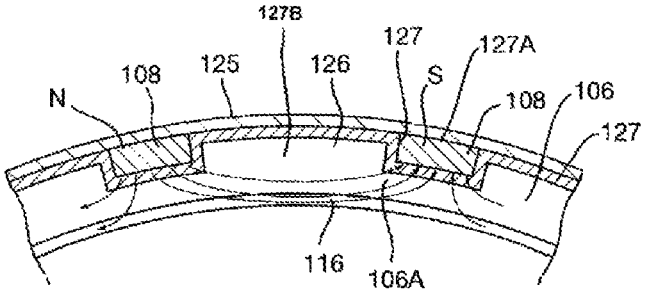
FIG. 8 is a partial cross section of the first and cylindrical portion of the second member of FIG. 7, in which the cylindrical portion of the second member has rectangular corrugations parallel to the axis and the magnets are mounted externally on the cylindrical portion of the second member is the grooves formed by the corrugations.

In FIG. 8, the cylindrical portion of the second member 126 has rectangular corrugations 127 extending along its length forming external grooves 127A, and internal grooves 127B, the latter forming elongate water passages between the cylindrical portion 126 of the second member and the cylindrical portion of the first member 116. The magnets 108 are mounted in the external grooves 127A, with alternating North and South poles (indicated by N and S) around the cylindrical portion of the second member, with high flux density between them. The gap 106A between the cylindrical portion of the first member and the base of the groove 127A is very small so that water in the passage 106 tends to flow though grooves 127B. Rotation of the cylindrical portion of the first member 116 with respect to the cylindrical portion of the second member through the flux induces eddy currents in the cylindrical portion of the first member which heats water in the passage 106 passing through the grooves 127B. The grooves 127B allow relatively larger volumes of water to pass through the heater when compared with the arrangement of FIG. 1. To maintain the magnets 108 in place, the cylindrical portion of the second member is surrounded by a backing plate 125, also made of a ferromagnetic material such as steel. The magnets are close together so that the grooves 127B are relatively narrow.

Performance of the embodiments shown in FIGS. 6 to 8 is further enhanced by placing longitudinal magnets on the inside of the cylinder portion of the first member first cylinder parallel to the axis of the first cylinder.

The invention claimed is:

1. A heat generator comprising a shaft, a fluid input and fluid output, first member and second member disposed around a shaft, the first member having a disc-like portion extending radially from the shaft, the second member with a plurality of magnets mounted thereon having a disc-like portion extending radially from the shaft and in which one of the members being rotated with respect to the other member and the first member has an electrically conducting portion intersecting the magnet fields of the magnets mounted on the second member and in which rotation of one member results in one or other of the magnetic field or the conducting member to rotate with respect to the other; in which the first member has an electrically conducting cylindrical portion extending laterally from the disc-like portion co-axially with the shaft; the second member has a cylindrical portion extending laterally from the disc-like portion co-axially with the shaft and with magnets mounted the cylindrical portion of said second member; and a passage for liquid to be heated is coaxial with the shaft, said passage being defined between the cylindrical portion of the second member and the electrically conducting cylindrical portion of the first member.

2. The heat generator according to claim 1 in which one of the members is mounted on the shaft and the other member is fixed.

3. The heat generator according to claim 2 in which the member mounted on the shaft drives an impeller, the impeller, in operation, urging liquid into the passage.

4. The heat generator according to claim 3 in which the impeller is formed on the surface of the disc-like portion of the said member opposite the disc-like portion of the other member.

5. The heat generator according to claim 2 having an inlet connected to a source of liquid under high-pressure and an impeller mounted on the rotatable member, the high-pressure liquid rotating the impeller and the member on which it is mounted.

6. The heat generator according to claim 5 in which in which an impeller is mounted on the rotating member the impeller is formed on the surface of the disc-like portion of the said member opposite the disc-like portion of the other member.

7. The heat generator according to claim 6 in which, after passing thorough the impeller, the liquid flows into the passage.

8. The heat generator according to claim 2 having a hydraulic motor mounted directly on or coupled to the rotatable member to rotate that member, the hydraulic motor being supplied with high pressure hydraulic fluid from a hydraulic pump.

9. The heat generator according to claim 8 in which the liquid driving the hydraulic pump is discharged from the pump into the passage between the first member and second member.

10. The heat generator according to claim 9 forming part of a closed loop system in which the heat from the heated liquid is recovered and the liquid passes through a pump to become the high-pressure supply to the hydraulic motor.

11. The heat generator according to claim 2 in which on the surface of the cylindrical portion of rotating member is formed as an impeller to drive liquid through the passage.

12. The heat generator according to claim 11 in which on the cylindrical portion of the rotating member is formed as a screw thread as the impeller.

13. The heat generator according to claim 2 in which the magnets are disposed around the outside of the cylindrical portion of the second member.

14. The heat generator according to claim 13 in which the cylindrical portion of the second member comprises corrugations, the corrugations being parallel to the axis of the heat generator, forming external and internal grooves, the magnets being mounted in the external grooves, and the internal grooves forming water passages.

15. The heat generator according to claim 2 in which the magnets are disposed longitudinally along the length of the cylindrical portion of the second member and parallel to the axis of the shaft.

16. The heat generator according to claim 15 in which the magnets are mounted in grooves of the second member.

17. The heat generator according to claim 15 in which one pole of each magnet mounted on the second member is coupled to a sheath of ferroelectric material.

18. The heat generator according to claim 2 having longitudinal magnets on the inside of the cylindrical portion of the first member and parallel to the axis of the cylindrical portion of the first member.

19. The heat generator according to claim 1 in which the first member comprises at least two coaxial electrically conducting cylinders, an inner cylinder and an outer cylinder, mounted on a common disc-like portion and the second member has one or more cylindrical portions nesting between the conducting cylinders, the cylindrical portion(s) of the second member having magnets mounted opposite the conducting cylinders, with two or more passages formed between the conducting cylinders and the cylindrical portion(s).

* * * * *